US007166961B2

(12) United States Patent
Park

(10) Patent No.: US 7,166,961 B2
(45) Date of Patent: Jan. 23, 2007

(54) PROTECTIVE FILM OF PLASMA DISPLAY PANEL AND METHOD OF FABRICATING THE SAME

(75) Inventor: Eung Chul Park, Kumi-shi (KR)

(73) Assignee: LG Electronics, Inc., Seoul (KR)

( * ) Notice: Subject to any disclaimer, the term of this patent is extended or adjusted under 35 U.S.C. 154(b) by 148 days.

(21) Appl. No.: 10/675,987

(22) Filed: Oct. 2, 2003

(65) Prior Publication Data

US 2004/0070341 A1 Apr. 15, 2004

(30) Foreign Application Priority Data

Oct. 10, 2002 (KR) ..... 10-2002-0061889

(51) Int. Cl.
*H01J 11/02* (2006.01)
*H01J 9/02* (2006.01)

(52) U.S. Cl. ..... 313/587; 313/582; 313/586; 315/169.3; 345/41; 345/66

(58) Field of Classification Search ..... 313/587, 313/590

See application file for complete search history.

(56) References Cited

U.S. PATENT DOCUMENTS 6,242,864 B1 * 6/2001 Nakahara et al. ..... 315/169.3
6,525,471 B1 * 2/2003 Bachmann et al. ..... 313/587
6,879,107 B1 * 4/2005 Hirano et al. ..... 313/587

FOREIGN PATENT DOCUMENTS

| | | | |
|---|---|---|---|
| JP | 01-135238 | | 5/1989 |
| JP | 09-208851 | | 8/1997 |
| JP | 10-297955 | | 11/1998 |
| JP | 10-334809 | | 12/1998 |
| JP | 11-029857 | | 2/1999 |
| JP | 1999-311975 | | 11/1999 |
| JP | 2000-063171 | | 2/2000 |
| JP | 2000063171 | A * | 2/2000 |
| JP | 2000-156166 | | 6/2000 |
| JP | 2000294153 | A * | 10/2000 |
| JP | 2003-272533 | A * | 9/2003 |
| JP | 2004-047193 | | 2/2004 |

OTHER PUBLICATIONS

EP Search Report dated Nov. 8, 2005.

* cited by examiner

*Primary Examiner*—Sikha Roy
(74) *Attorney, Agent, or Firm*—Fleshner & Kim LLP

(57) ABSTRACT

An improved protective film for a plasma display panel and a fabricating method thereof are provided. The improved protective film has magnesium oxide (MgO) as its main component, and uses a slight addition of silicon (Si) to improve jitter characteristics experienced during the address period.

15 Claims, 6 Drawing Sheets

PROTECTIVE FILM OF PLASMA DISPLAY PANEL AND METHOD OF FABRICATING THE SAME

BACKGROUND OF THE INVENTION

1. Field of the Invention

This invention relates to a plasma display panel, and more particularly to a protective film of a plasma display panel and a fabricating method thereof that are adaptive for reducing a jitter value of an address period.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a sustain electrode pair having a scan electrode Y and a sustain electrode Z provided on an upper substrate 1, and an address electrode X provided on a lower substrate 2 in such a manner to be perpendicular to the sustain electrode pair.

Each of the scan electrode Y and the sustain electrode Z consists of a transparent electrode and a metal bus electrode thereon.

On the upper substrate 1 provided with the scan electrode Y and the sustain electrode Z, an upper dielectric layer 6 and a MgO protective film 7 are disposed. The MgO protective film 7 plays a role to protect a sputtering of particles generated by a discharge as well as enhance an emission effect of secondary electrons.

A lower dielectric layer 4 are formed on the lower substrate 2 provided with the address electrode X in such a manner to cover the address electrode X. Barrier ribs 3 are formed vertically above the lower dielectric layer 4. A phosphorous material 5 is coated onto the surfaces of the lower dielectric layer 4 and the barrier ribs 3.

The upper substrate 1 is joined to the lower substrate by means of a sealant (not shown). An inactive mixture gas such as He+Xe, Ne+Xe or He+Ne+Xe is injected into a discharge space provided among the upper substrate 1, the lower substrate 2 and the barrier ribs 3.

Such a PDP makes a time-divisional driving of one frame, which is divided into various sub-fields having a different emission frequency and adopts an address display separated (ADS) system in which an addressing is separated from a display, so as to realize gray levels of a picture. Each sub-field is again divided into a reset period for initializing the entire field, an address period for selecting a scan line and selecting the cell from the selected scan line and a sustain period for expressing gray levels depending on the discharge frequency. The reset period is divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into a reset period, an address period and a sustain period as mentioned above. Herein, the reset period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 and FIG. 4 show driving waveforms of the PDP shown in FIG. 1.

Referring to FIG. 3, the PDP is divided into a reset period, an address period and a sustain period for its driving.

In the reset period, a rising ramp waveform Ramp-up is applied to all the scan electrodes Y in a set-up interval SU. A discharge is generated within the cells of the full field with the aid of the rising ramp waveform Ramp-up. By this set-up discharge, positive wall charges are accumulated onto the address electrode X and the sustain electrode Z while negative wall charges are accumulated onto the scan electrode Y.

After a set-up discharge, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the reset period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the sustain electrodes Z during the set-down interval and the address period. The direct current voltage Zdc causes a set-down discharge between the sustain electrode Z and the scan electrode Y, and establishes a voltage difference between the sustain electrode Z and the scan electrode Y or between the sustain electrode Z and the address electrode X so as not to make a strong discharge between the scan electrode Y and the sustain electrode Z in the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied.

Just after the sustain discharge was finished, rectangular waves ers1 and ers2 having a small pulse width and a ramp waveform ers3 having a low voltage level are applied to the sustain electrode Z as erasure signals for erasing electric charges within the cell. If such erasure signals ers1, ers2 and ers3 are applied within the cell, then an erasure discharge occurs to thereby erase wall charges generated by the sustain discharge and left.

Driving waveforms shown in FIG. 4 is different from driving waveforms shown in FIG. 3 in that an initialization waveform applied in the reset period should be rectangular waves rst1, rst2 and rst3 and a rising ramp waveform Ramp-up applied alternately to the scan electrode Y and the sustain electrode Z. Further, signals applied to each electrode X, Y and Z during the address period and the sustain period are substantially identical to those shown in FIG. 3.

In order to implement a high picture quality, such a PDP requires a high definition, a high brightness, a high contrast ratio and a low contour noise, etc. Also, in order to implement a high picture quality, the PDP assures an appropriate address period in the ADS driving system. Since the number of lines to be scanned is increased as the PDP develops into a higher definition/higher resolution, the address period is lengthened and an assurance of the sustain period becomes difficult. For instance, when 480 scan lines exist; a scanning time of 3 μs per line is required; a single scan system in which the scan lines are scanned sequentially from the first scan line until the last line is adopted; and a driving is made with one frame being divided into eight sub-field, an address period required within one frame becomes more than 480×3 μs×8=13 ms. Thus, a time to be assigned in the sustain period within one frame becomes (16.67 ms–13 ms) which is absolutely insufficient. A scanning time must be reduced so as to assign a time more than such an insufficient sustain period, but it is difficult to reduce an address period because a width of the scanning pulse is defined largely in consideration of a jitter upon address discharge. The jitter is a discharge delay time generated upon address discharge. The jitter has some differences for each sub-field and has a certain range upon driving. Since the scanning pulse includes such a jitter value, the pulse of the scanning pulse width becomes longer. Accordingly, since the address period becomes longer as a jitter value goes larger, it becomes difficult to implement a high picture quality. The jitter value is liable to be more increased as a temperature or an neighbor temperature of the PDP goes lower. This forces the PDP to make an unstable address discharge at a low temperature. Thus, since a miss writing causing a failure of cell selection occurs to emerge a black noise on a displayed picture, an environment confrontation ability is deteriorated. In the mean time, Japanese Patent Laid-open Gazette No. 2001-135238 has suggested a PDP wherein a content of Xe in a discharge gas sealed within the PDP is increased into more than 5 volume %, thereby allowing a higher driving voltage and a much higher brightness in comparison to the conventional low-density Xe panel. However, a high-density Xe panel has a larger jitter value of the address period as a content of Xe goes higher. Accordingly, it is difficult to implement a high-density Xe panel due to such a jitter value of the address period.

A factor making a largest affect to a jitter value of the address period is a secondary electron emission characteristic of the protective film 7. Since a jitter is more reduced as a secondary electron emission efficiency of the protective film 7 goes higher and hence a pulse width of the scanning pulse is reduced by the reduced jitter value, it is possible to shorten the address period.

SUMMARY OF THE INVENTION

Accordingly, it is an object of the present invention to provide a protective film of a plasma display panel and a fabricating method thereof that are adaptive for reducing In order to achieve these and other objects of the invention, a protective film of a plasma display panel according to one aspect of the present invention includes a main component of magnesium oxide (MgO) and an addition of silcon (Si) less than 500 wt. ppm.

In the protective film, a content of the added silicon is preferably about 20 ppm to 300 ppm.

The protective film further includes and addition of calcium (Ca) less than 50 wt. ppm,iron (Fe) less than 50 wt. ppm, aluminum (Al) less than 250 wt. ppm, nickel (Ni) less than 5 wt. ppm, natrium (Na) less than 5 wt. ppm and potassium (K) less than 5. ppm.

Herein, a discharge gas containing xenon (Xe) more than 5 volume % is selected within the plasma display panel.

A method of fabricating a protective film of a plasma display panel according to another aspect of the present invention includes the step of forming the protective film having a main component of magnesium oxide (MgO) and an addition of silcon (Si) less than 500 wt. ppm.

In the method, the protective film is formed on the plasma display panel by a vacuum deposition process.

Otherwise, the protective film is formed on the plasma display panel by any one process of a chemical vapor deposition (CVD), a E-beam process, an ion-plating and a sputtering.

Herein, a content of the added silicon is preferably about 20 ppm to 300 ppm.

The protective film further includes an addition of calcium (Ca) less than 50 wt. ppm, iron (Fe) less than 50 wt. ppm, aluminum (Al) less than 250 wt. ppm, nickel (Ni) less than 5 wt. ppm, natrium (Na) less than 5 wt. ppm and potassium (K)less than 5 wt. ppm.

The method further includes the step of sealing a discharge gas containing xenon (Xe) more than 5 Vol % within the plasma display panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
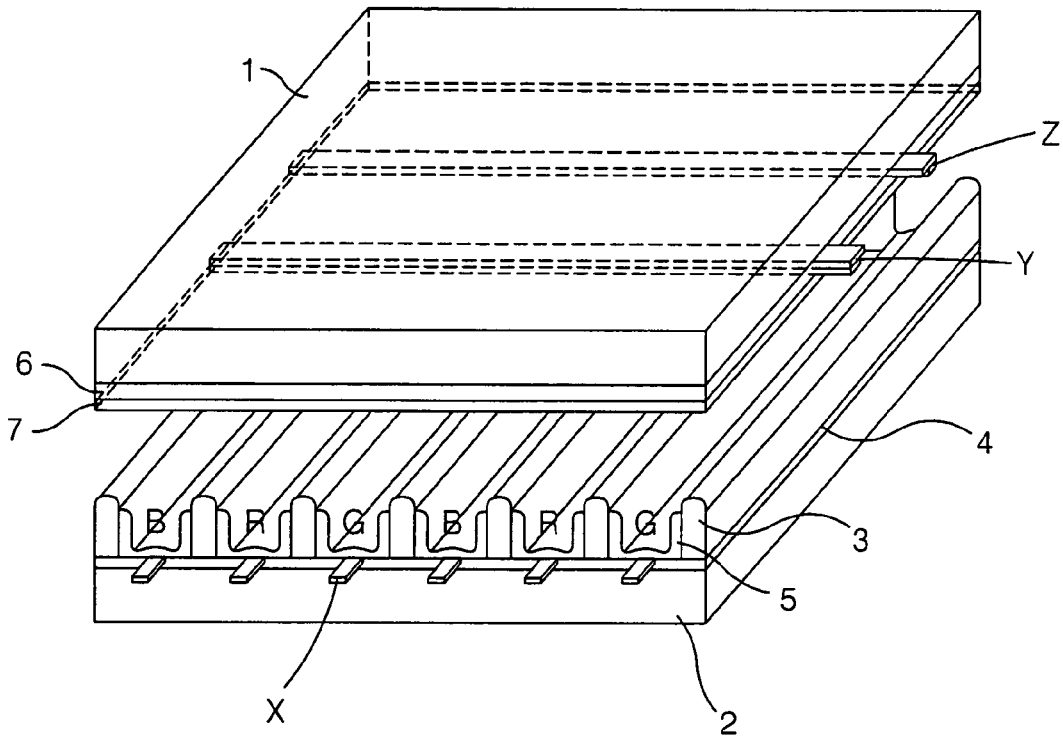
FIG. 1 RELATED ART
FIG. 1 is a perspective view showing a discharge cell structure of a conventional three-electrode, AC surface-discharge plasma display panel (PDP)
Figure 2:
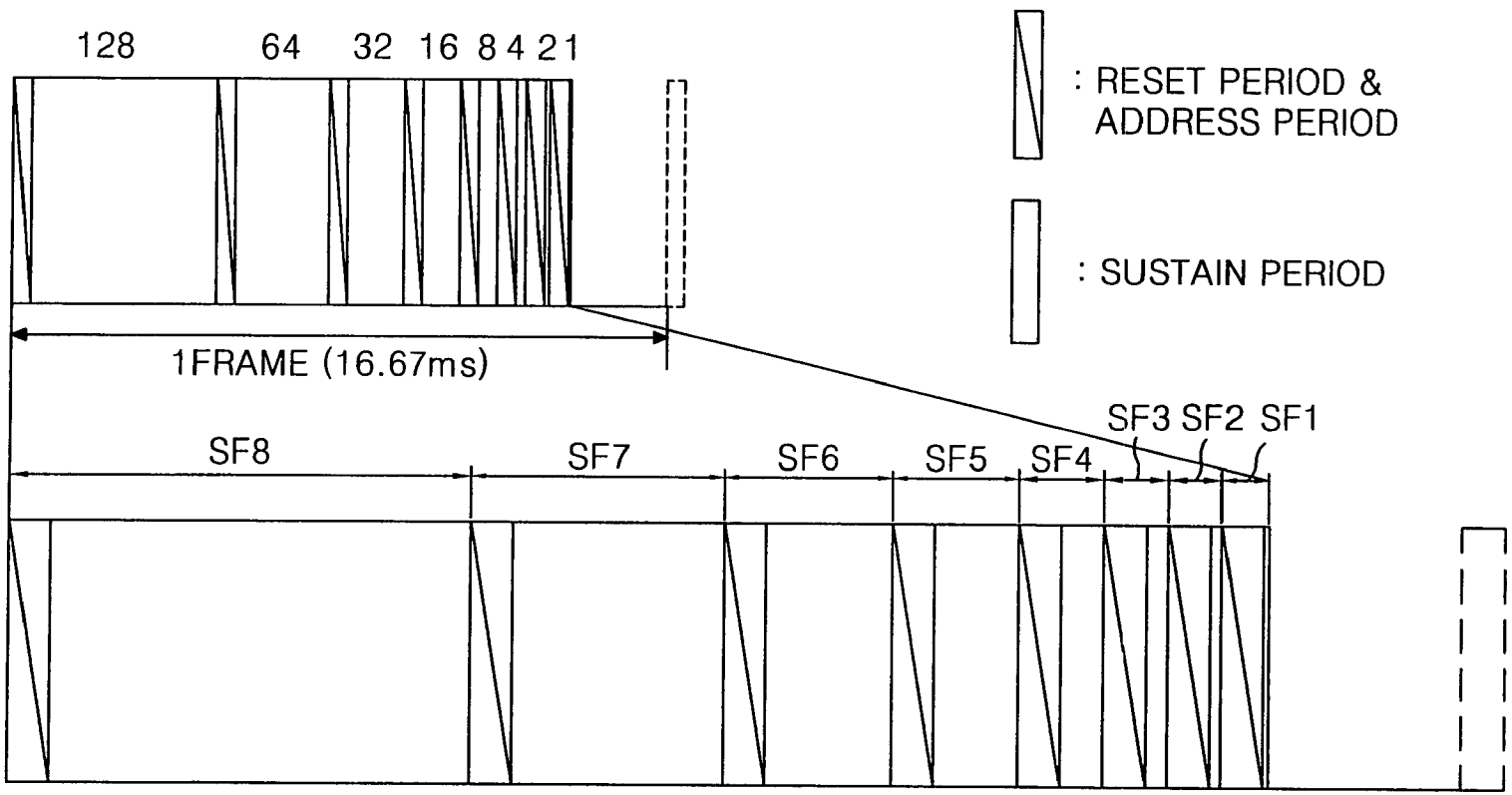
FIG. 2 RELATED ART
FIG. 2 illustrates a frame configuration having a 8-bit default code for implementing 256 gray levels.
Figure 3:
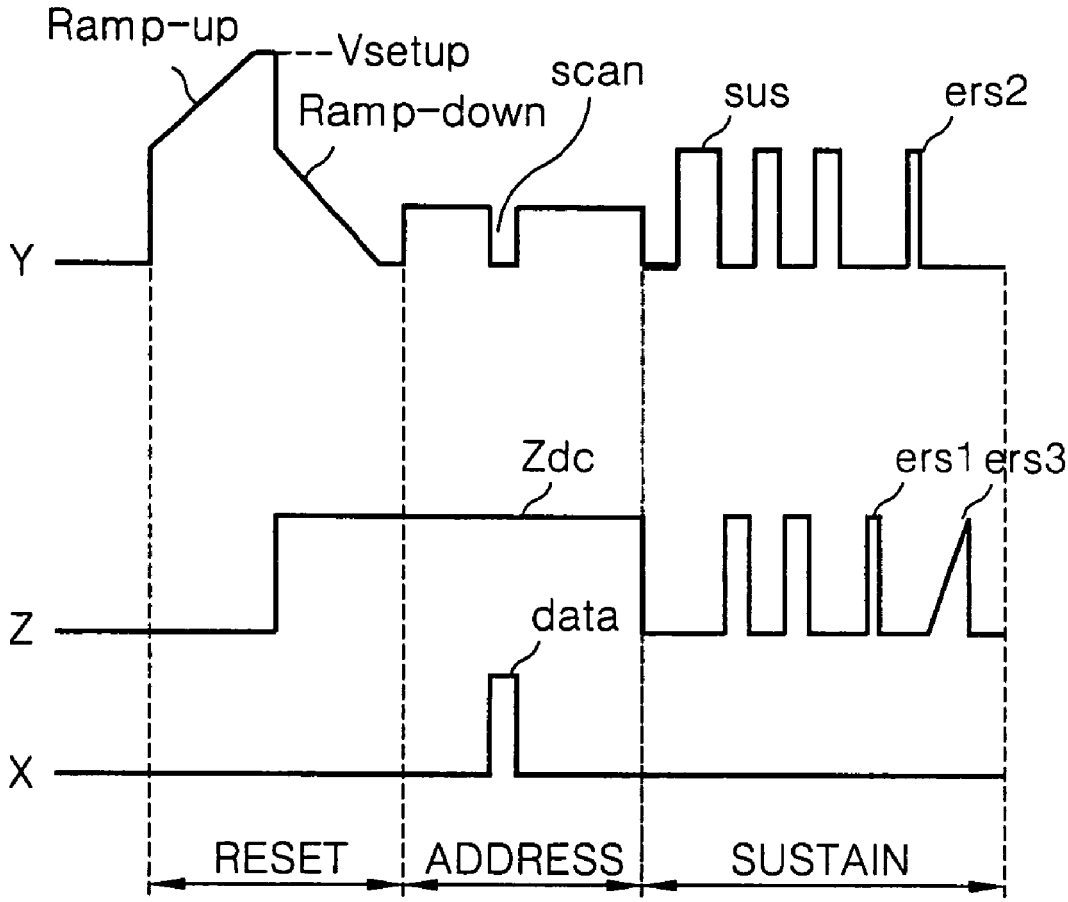
FIG. 3 RELATED ART
FIG. 3 is a waveform diagram of driving signals for driving the conventional PDP.
Figure 4:
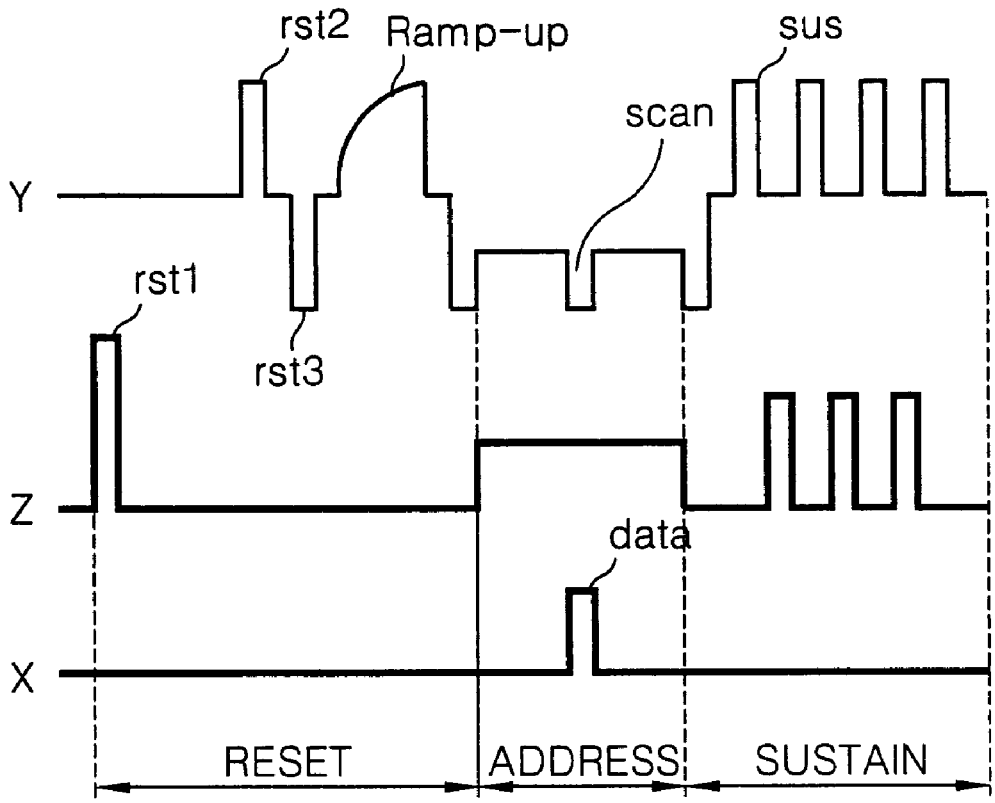
FIG. 4 RELATED ART
FIG. 4 is a waveform diagram of another example of driving signals for driving the conventional PDP.
Figure 5:
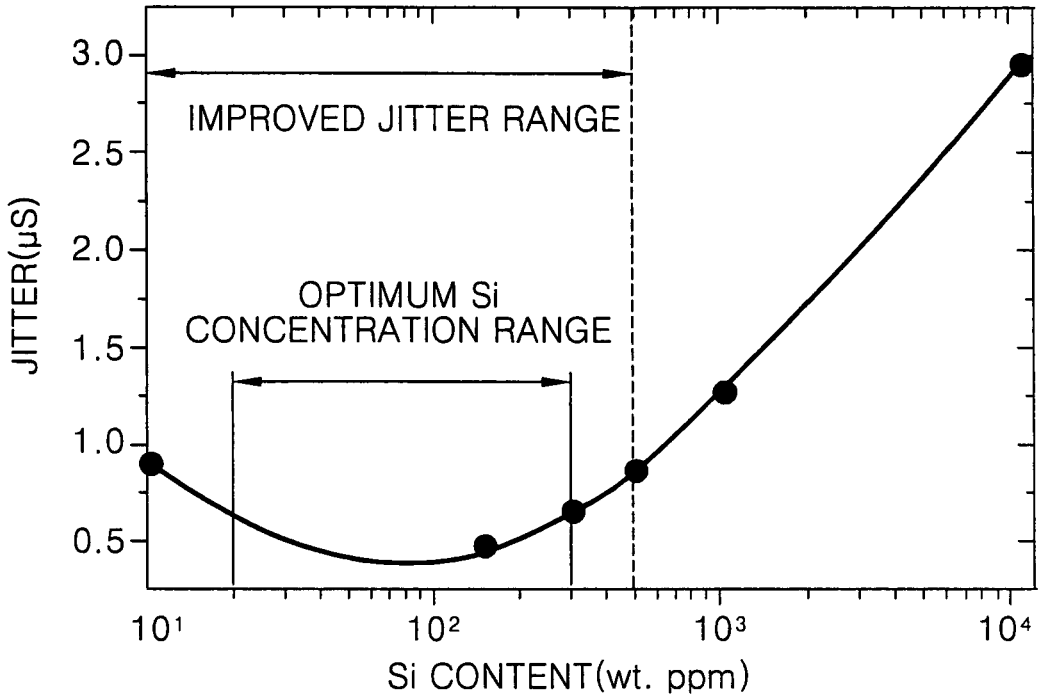
FIG. 5 is a graph showing a variation in a jitter value according to a content of silicon (Si) in a protective film of a PDP according to an embodiment of the present invention.

Referring to FIG. 5, a protective film of a PDP according to an embodiment of the present invention has a main component of MgO and includes a slight content of Si as a concentration set within a range in which a jitter is minimized. In FIG. 5, the vertical axis represents a jitter value (μs), and the horizontal axis does a content amount (Wt-.ppm) of Si.

The protective film according to the embodiment of the present invention is formed on the upper substrate by a vacuum deposition technique such as a chemical vapor deposition, an ion-plating or a sputtering, etc.

There are various method adding a slight content of Si when the protective film according to the embodiment of the present invention using the vacuum deposition technique.

The protective film may be deposited by a single source by adding a slight content of Si to a source material and a target, etc. (hereinafter referred to as "source material") used for the vacuum deposition. Alternatively, silicon (Si) may be added to the protective film by using both the existent MgO and Si as a source. In this case, a content of Si can be controlled by an adjustment of a power applied to the silicon source. Herein, the source material is prepared by as a sea water or a magnesium in the rough in which a component of MgO is more than 99.5 wt %. In this case, calcium (Ca) less than 300 ppm, iron (Fe) less than 500 ppm, aluminum (Al) less than 250 ppm, nickel (Ni) less than 5 ppm, natrium (Na) less than 5 ppm and potassium (K) less than 5 ppm can be contained as impurities. Also, silicon (Si) less than 5000 ppm is added as indicated by the following Table 1. In other words, a slight content of silicon (Si) for improving a secondary electron emission characteristic of the protective film is included in the source material as indicated by the following Table 1.

TABLE 1

| | |
|---|---|
| MgO | 99.5 wt %~99.99999 wt % |
| Si | Below 5000 wt. ppm |

By such a protective film deposition method, an MgO protective film is deposited onto an upper substrate of the PDP provided with a sustain electrode pair Y and Z and a dielectric layer. The protective film formed on the upper substrate of the PDP by such a deposition process and added with a slight content of Si slightly contains a magnesium oxide (MgO) close to 100 wt. % and silicon (Si) less than 500 wt. ppm for improving a secondary electron emission characteristic of the protective film as indicated by the following Table 2.

TABLE 2

| | |
|---|---|
| MgO | 99.5 wt %~99.99999 wt % |
| Si | Below 500 wt. ppm |

Alternatively, the protective film formed on the PDP may contain calcium (Ca) less than 50 wt. ppm, iron (Fe) less than 50 wt. ppm, aluminum (Al) less than 250 wt. ppm, nickel (Ni) less than 5 wt. ppm, natrium (Na) less than 5 wt. ppm and potassium (K) less than 5 wt. ppm.

In the above Tables 1 and 2, the reduction of a content of the source material and a content of silicon (Si) in the protective film really formed on the PDP results from a control of process parameters upon deposition process. For instance, if a pressure within a deposition equipment is heightened or a distance between the substrate of the PDP and the source material is increased, then a silicon content of the protective film formed on the substrate of the PDP is more reduced in comparison to that of the source material.

The silicon (Si) is slightly added to the magnesium oxide (MgO), thereby playing a role to compensate for an Oxygen vacancy defect in a MgO crystalline and a secondary electron emission efficiency of the protective film deteriorated due to an impurity. In other words, when the protective film is formed by the vacuum deposition, crystalline defects followed necessarily in the course of the process and impurities, such as calcium (Ca), iron (Fe), aluminum (Al), nickel (Ni), Natrium (Na) and potassium (K), inputted from the source material acts as factors causing a deterioration of electron emission characteristic. The silicon (Si) compensates for the secondary electron emission characteristic deteriorated due to crystalline defects and impurities, thereby reducing a jitter value of the address period.

As can be seen from FIG. 5, such an addition of the silicon (Si) can reduce a jitter value of the address period. However, if a content of the silicon (Si) is increased beyond a certain value, then a jitter is liable to be increased. Accordingly, it is desirable that the silicon (Si) having a content within a range capable of minimizing a jitter should be added to the protective film. To this end, a content of the silicon (Si) can be changed depending upon a content of another impurity and a deposition condition, etc., but an optimum content of the silicon (Si) added to the protective film is preferably about 20 wt. ppm to 300 wt. ppm.

The jitter characteristic shown in FIG. 5 has been obtained by applying a driving waveform to the PDP and then measuring a light waveform generated upon addressing with a single of cell. A low gray level of line patterns are used as a measuring pattern in this experiment has used in order to minimize a priming effect.

According to an experiment that is made individually at tens of rounds while changing a kind of discharge gas sealed within the PDP, the protective film to which the silicon (Si) is added has an improved secondary electron emission characteristic irrespectively of a kind of discharge gas.

Figure 6:
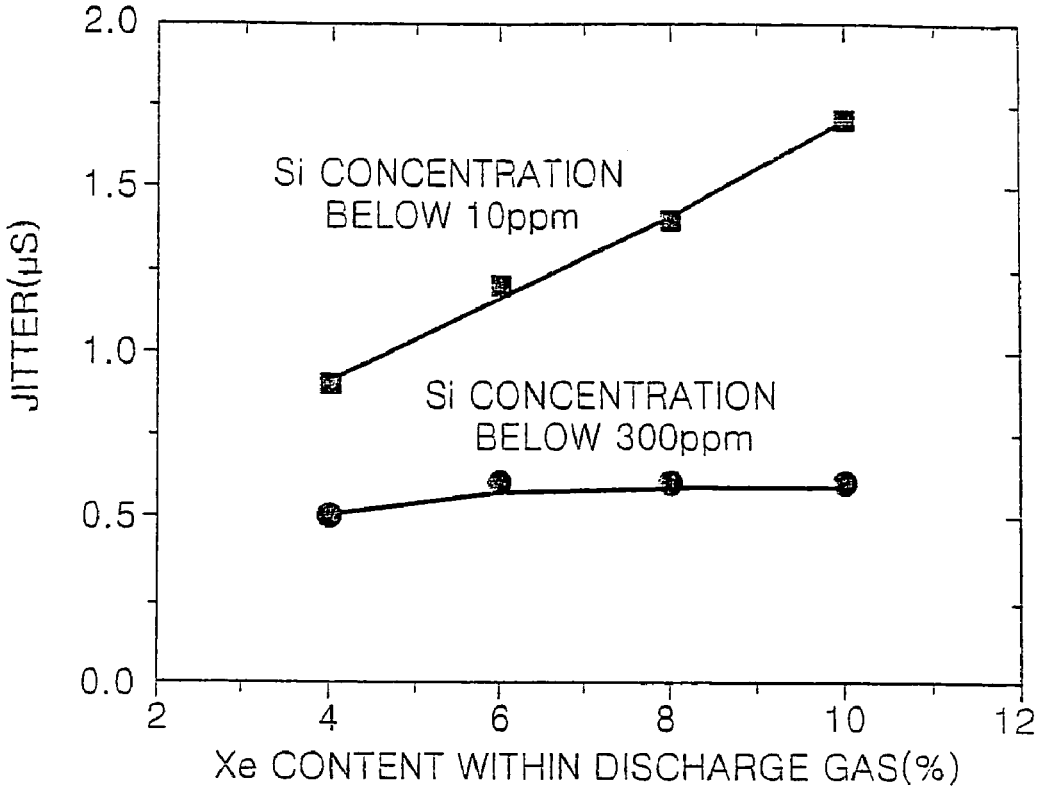
FIG. 6 is a graph showing a variation in a jitter value according to contents of xenon (Xe) and silicon (Si) in a protective film of a PDP according to an embodiment of the present invention.

FIG. 6 shows an experiment result of a jitter characteristic for the protective film to which the silcon (Si) is added in a PDP sealed with a high-density Xe discharge gas containing xeno (Xe) more than 5 volume %.

As can be seen from FIG. 6, when the protective film of the PDP into which a high-density XE discharge gas is sealed has a main component of magnesium oxide (MgO) and an addition of silicon (Si) less than 300 wt. ppm, then a jitter value of the address period shows a very low level that is approximately less than 0.6 μs.

Accordingly, if the protective film according to the present invention is applied to a high-density Xe panel, then it becomes possible to obtain a high brightness and a high-speed driving as well as an implementation of high resolution and to improve an confrontation ability to the external temperature.

As described above, according to present invention, silicon is added to the protective film to improve a secondary electron emission characteristic of the protective film, thereby reducing a jitter of the address period. As a result, a stable address operation in the PDP is made within a short time, so that a stable and effective address operation can be obtained even at a low temperature environment. Furthermore, according to the present invention, a sufficient sustain period can be assured by a reduction of the address period and the number of sub-fields can be increased so as to reduce a contour noise, so that it becomes possible to implement a high picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A protective film of a plasma display panel, comprising:

a main component comprising magnesium oxide (MgO); and an addition of silicon (Si), wherein less than 500 wt. ppm and greater than 200 wt. ppm of silicon is added to the main component to produce said protective film.

2. The protective film as claimed in claim 1, wherein said addition of silicon is greater than 200 wt. ppm and at most 300 wt. ppm.

3. The protective film as claimed in claim 1, wherein the protective film further comprises:

calcium (Ca) less than 50 wt. ppm;

iron (Fe) less than 50 wt. ppm; and aluminum (Al) less than 250 wt. ppm.

4. The protective film as claimed in claim 3, wherein the protective film further comprises:

nickel (Ni) less than 5 wt. ppm;

sodium (Na) less than 5 wt. ppm; and potassium (K) less than 5 wt. ppm.

5. The protective film as claimed in claim 1, wherein said protective film has about 300 wt. ppm of silicon.

6. The protective film as claimed in claim 1, wherein the addition of silicon compensates for secondary electron emission characteristics deteriorated by crystalline defects and impurities.

7. The protective film as claimed in claim 1, wherein the addition of silicon is a predetermined amount required to reduce a jitter value within the plasma display panel during address to within a predetermined range.

8. The protective film as claimed in claim 1, wherein the protective film further comprises:

nickel (Ni) less than 5 wt. ppm;

sodium (Na) less than 5 wt. ppm; and potassium (K) less than 5 wt. ppm.

9. A plasma display panel, comprising:

an upper substrate;

a lower substrate across from the upper substrate;

a plurality of electrodes on the upper substrate;

a protective film on the upper substrate layer; and a plurality of electrodes on the lower substrate, wherein said protective film comprises a main component of magnesium oxide and an addition of a predetermined amount of silicon, wherein greater than 200 wt. ppm and less than 500 wt. ppm of silicon is added to the main component to produce said protective film.

10. The plasma display panel as claimed in claim 9, wherein said protective film comprises an addition of silicon of at most 300 wt. ppm.

11. The plasma display panel as claimed in claim 9, wherein the protective film further comprises:

calcium (Ca) less than 50.wt. ppm;

iron (Fe) less than 50 wt. ppm; and aluminum (A1) less than 250 wt. ppm.

12. The plasma display panel as claimed in claim 11, wherein the protective film further comprises:

an upper dielectric layer on the upper substrate.

13. The plasma display panel as claimed in claim 9, further comprising a discharge gas between the upper and lower substrates, wherein said discharge gas contains 5 volume % Xenon or more.

14. The plasma display panel as claimed in claim 9, wherein the protective film further comprises:

nickel (Ni) less than 5 wt. ppm;

sodium (Na) less than 5 wt. ppm; and potassium (K) less than 5 wt. ppm.

15. A protective film of a plasma display panel, comprising:

magnesium oxide (MgO); and silicon (Si), wherein said protective film has about 300 wt. ppm of silicon.

* * * * *